US012276119B2

(12) United States Patent
Labonté

(10) Patent No.: US 12,276,119 B2
(45) Date of Patent: Apr. 15, 2025

(54) TRANSITION MOULDING

(71) Applicant: Paul-André Labonté, Trois-Rivières (CA)

(72) Inventor: Paul-André Labonté, Trois-Rivières (CA)

( * ) Notice: Subject to any disclaimer, the term of this patent is extended or adjusted under 35 U.S.C. 154(b) by 226 days.

(21) Appl. No.: 18/079,915

(22) Filed: Dec. 13, 2022

(65) Prior Publication Data

US 2023/0183990 A1 Jun. 15, 2023

(30) Foreign Application Priority Data

Dec. 13, 2021 (GB) ..... 2118013

(51) Int. Cl.
*E04F 19/06* (2006.01)

(52) U.S. Cl.
CPC ..... *E04F 19/062* (2013.01)

(58) Field of Classification Search
CPC ... E04F 19/065; E04F 19/06; E04F 15/02016; E04F 13/0898; E04F 19/066; E04F 19/062; E04D 3/366
USPC ... 52/98, 100, 395, 459, 461, 464, 465, 466, 52/468, 470
See application file for complete search history.

(56) References Cited

U.S. PATENT DOCUMENTS 2,487,571 A 11/1949 Maxwell
2,557,845 A * 6/1951 Sokolik ..... A47G 27/045 16/7
2,770,002 A 11/1956 Thompson
3,200,547 A 8/1965 Johnson
3,254,361 A * 6/1966 Craven ..... A47G 27/0462 16/16
3,408,250 A 10/1968 Finefrock
4,067,155 A * 1/1978 Ruff ..... E04B 1/6803 52/287.1
5,423,154 A 6/1995 Maylon et al.
5,706,623 A 1/1998 Brown
5,756,176 A 5/1998 Feld
6,138,323 A * 10/2000 Thøgersen ..... A47G 27/045 16/16
6,230,385 B1 * 5/2001 Nelson ..... E04F 19/062 52/468
6,340,264 B1 * 1/2002 Nelson ..... E04F 19/066 403/297
6,588,165 B1 * 7/2003 Wright ..... E04F 19/06 52/459
7,207,143 B2 * 4/2007 Stanchfield ..... E04D 1/365 52/312
7,814,720 B2 * 10/2010 Neuhofer ..... E04F 19/061 52/459

(Continued)

*Primary Examiner* — Brian E Glessner
*Assistant Examiner* — Adam G Barlow

(57) ABSTRACT

The present invention provides a transition moulding comprised of an elongate piece having three strips of adhesive material, a plurality of holes, and thin lateral beveled edges. The holes are for embedding adhesive or mortar as well as placing mechanical fasteners to secure the moulding to the sub floor. The adhesive bands are for securing the flooring material and the central adhesive band is for placing a clip that is configured and sized to hold a "T" separator placed between the two flooring materials. There is also a crease to facilitate the folding or breaking of the moulding for when it is used against a wall or at the end of a floor such as on door sills or staircase.

7 Claims, 2 Drawing Sheets

(56) References Cited

U.S. PATENT DOCUMENTS

| | | | | |
|---|---|---|---|---|
| 8,109,059 | B2 * | 2/2012 | Proot | E04F 19/061 52/312 |
| 8,205,410 | B2 | 6/2012 | Stanchfield | |
| 9,631,376 | B2 | 4/2017 | Mowers et al. | |
| D923,821 | S | 6/2021 | Balz, Jr. et al. | |
| 11,124,975 | B1 * | 9/2021 | Bremer | B29C 48/21 |
| 2003/0084634 | A1 * | 5/2003 | Stanchfield | E04F 19/06 52/464 |
| 2005/0003149 | A1 * | 1/2005 | Kornfalt | B27N 7/005 264/145 |
| 2006/0201093 | A1 * | 9/2006 | Stanchfield | E04F 19/068 52/459 |
| 2006/0260241 | A1 * | 11/2006 | Stanchfield | E04F 19/065 52/459 |
| 2007/0056239 | A1 * | 3/2007 | Schacht | E04F 19/062 52/582.1 |
| 2007/0283654 | A1 * | 12/2007 | Stanchfield | E04F 19/061 52/749.1 |
| 2008/0034691 | A1 * | 2/2008 | Nelson | B32B 15/20 52/395 |
| 2008/0034700 | A1 * | 2/2008 | Stanchfield | E04F 11/166 52/582.1 |
| 2008/0263983 | A1 * | 10/2008 | Stanchfield | E04F 11/166 52/459 |
| 2010/0218448 | A1 * | 9/2010 | Schacht | E04F 19/062 52/464 |
| 2012/0042596 | A1 | 2/2012 | Schacht | |
| 2013/0104481 | A1 | 5/2013 | Urban et al. | |
| 2023/0417069 | A1 * | 12/2023 | Bremer | B29C 48/12 |

* cited by examiner

FIG. 2A
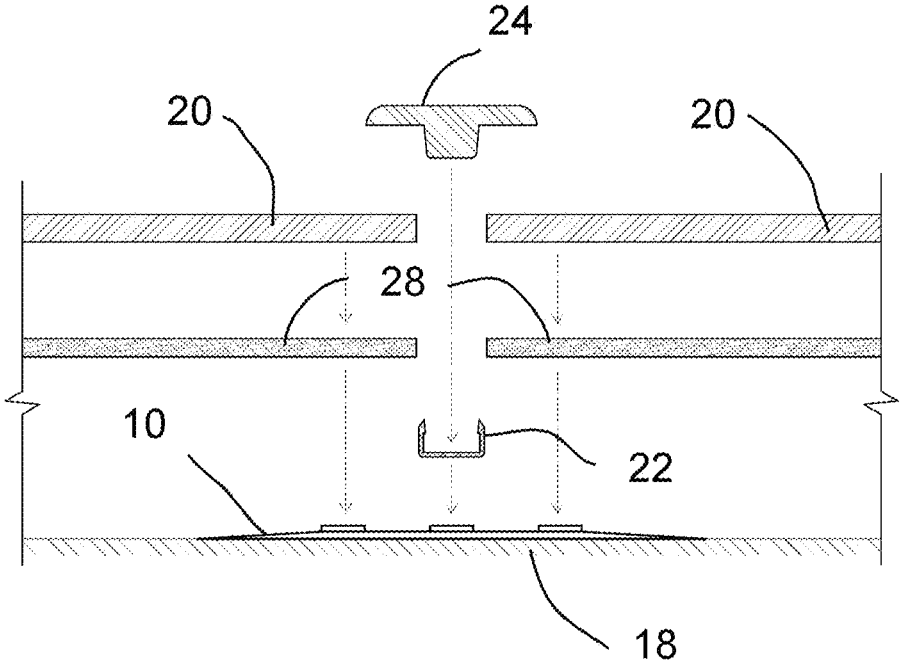
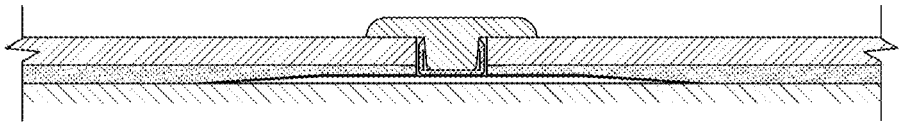
FIG. 2B

TRANSITION MOULDING

CROSS-REFERENCE TO RELATED APPLICATIONS

The present application claims priority to application number GB2118013.8, filed on Dec. 13, 2022, the disclosure of which is hereby incorporated in its entirety at least by reference.

BACKGROUND OF THE INVENTION

1. Field of the Invention

The present invention relates to flooring hardware and moulding but more particularly to transition moulding.

2. Description of Related Art

The use of transition moulding between two different types of flooring material, such as between carpet and tiles or wood and tiles is well known in the art. The problem is that more often than not, installers use the wrong type of moulding, or non at all and compensate by using adhesive or nails Existing mouldings do not do a good job at securing the two different types of flooring material used. Usually current mouldings seem to be better on one type of flooring on one side of moulding over the other type of flooring used on the other side of the moulding. There is room for improvement in that art.

Example of prior art include U.S. Pat. No. 5,756,176 describes a moulding which notably discloses openings which can receive glue or a similar material.

U.S. Pat. Nos. 6,230,385 and 6,340,264 describe an elongated moulding which is notably provided with an integrated U-shaped support tab which receives a T-type separator. For U.S. Pat. No. 6,340,264, the profile of the moulding can be slightly lowered in slope on the sides.

U.S. Pat. Nos. 7,207,143 and 8,205,410, describe a moulding which notably has a central U-shaped support tongue which receives a T-type separator. The separator can take various configurations.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention, a transition moulding assembly is provided, comprising an elongated rectangular moulding element having a top surface, a bottom surface, and a pair of beveled lateral edges, wherein the bottom surface is configured to be secured to a sub-floor. A first adhesive band centrally positioned on the top surface of the elongated rectangular moulding element. A second adhesive band and a third adhesive band, each positioned on opposite sides of the first adhesive band, wherein the second and third adhesive bands are configured to secure a first floor material set and a second floor material set to the top surface of the elongated rectangular moulding element either directly or indirectly respectively. A T-separator configured to adjoin the first floor material set and the second floor material set, wherein the T-separator is secured via a mechanical element adhered to the assembly via the first adhesive band.

In one embodiment, the elongated rectangular moulding element includes a plurality of oblong holes for embedding adhesive or mortar and a plurality of round holes for placing mechanical fasteners to secure the elongated rectangular moulding element to the sub-floor.

In one embodiment, the first, second, and third adhesive band extend the entire length of the elongated rectangular moulding element on the top surface.

In another embodiment, the mechanical element is a clip.

In another embodiment, the first adhesive band is constructed from compressible material.

In yet another embodiment, the first floor material set and the second floor material set includes padding material or cement.

In one embodiment, the elongated rectangular moulding element includes a crease running the entire length of the element to facilitate the folding or breaking of the element for when it is used against a wall or at the end of a floor such as on door sills or staircase.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which:

FIG. 2A is an exploded view of the transition moulding according to an embodiment of the present invention.

FIG. 2B is an assembled view of the transition moulding according to an embodiment of the present invention.

DETAILED DESCRIPTION OF THE PREFERRED EMBODIMENT

Figures 1A, 1B, 1C:
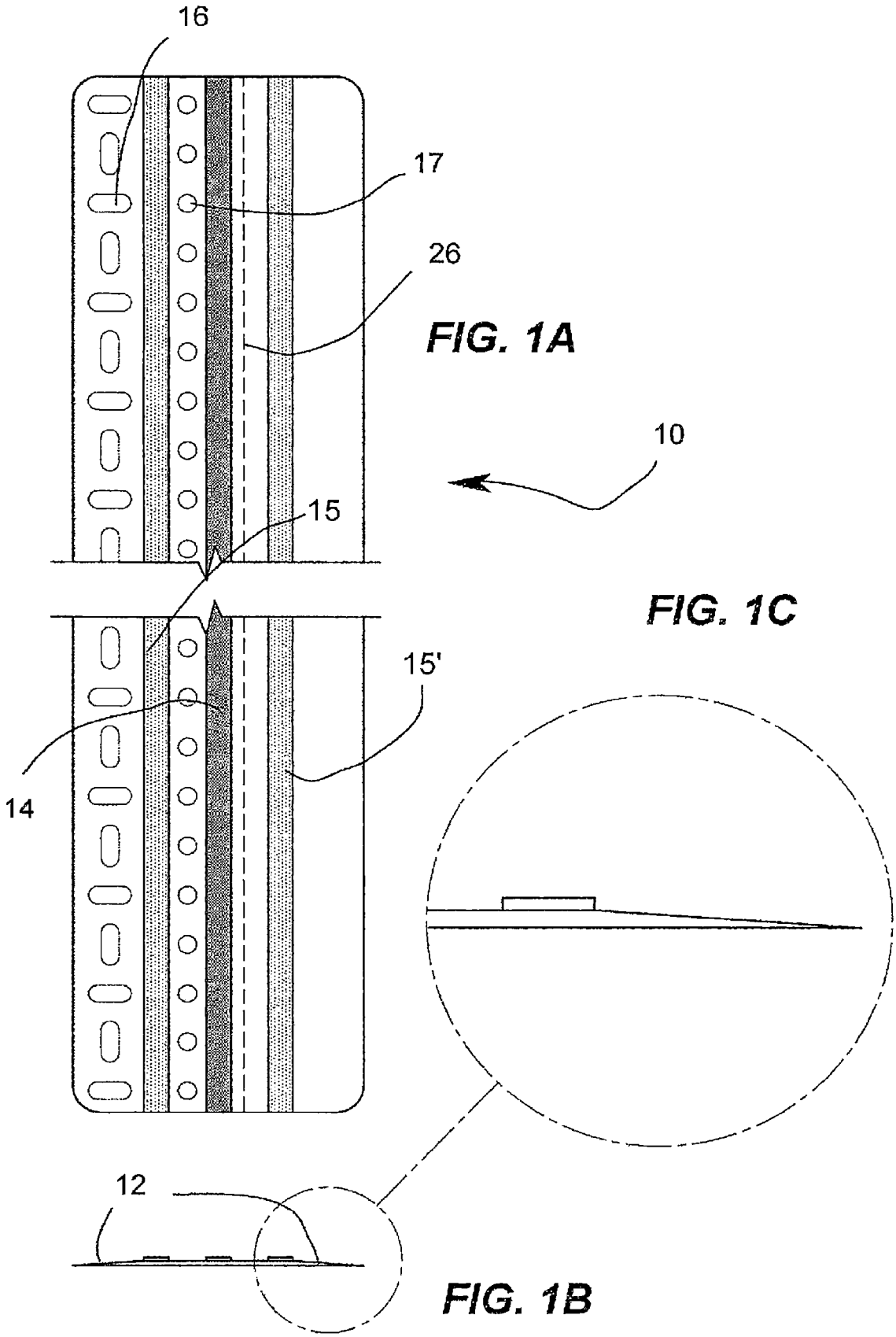
FIG. 1A is a top view of the transition moulding according to an embodiment of the present invention.
FIG. 1B a side view of the transition moulding according to an embodiment of the present invention.
FIG. 1C is a detailed view of FIG. 1B.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a ladder lateral stabilizer accessory.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about", "generally", or "approximately" apply to all numeric values, whether or not explicitly indicated. These terms generally refer to a range of numbers that one of skill in the art would consider near the stated amount by about 0%, 5%, or 10%, including increments therein. In many instances these terms may include numbers that are rounded to the nearest significant figure.

Referring now to any of the accompanying FIGS. 1A-C and 2A-B, a transition moulding 10 is provided. In one embodiment, the transition moulding 10 includes an elongate shape with a pair of beveled lateral edges 12. In some embodiments, there is a central compressible adhesive band 14, wherein the central compressible adhesive band is foam like. The transition moulding 10 further includes two lateral adhesive bands 15, 15', wherein the central compressible adhesive band 14 and two lateral adhesive bands 15, 15' all running along the length of the moulding 10.

Further provided is a plurality of oblong holes 16 for embedding adhesive or mortar as well as round holes 17 for placing mechanical fasteners to secure the moulding 10 to the sub-floor 18.

The lateral adhesive bands 15, 15' are for securing flooring materials 20 and the central adhesive band 14 is for placing a clip 22 that is configured and sized to hold a "T" separator 24 placed between the two flooring materials 20. In some embodiments, there is also a crease 26 to facilitate the folding or breaking of the moulding 10 for when it is used against a wall or at the end of a floor such as on door sills or a staircase. In some embodiments, the flooring material may need either padding material or cement 28.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A transition moulding assembly comprising:

an elongated rectangular moulding element having a top surface, a bottom surface, and a pair of beveled lateral edges, wherein the bottom surface is configured to be secured to a sub-floor;

a first adhesive band centrally positioned on the top surface of the elongated rectangular moulding element;

a second adhesive band and a third adhesive band, each positioned on opposite sides of the first adhesive band, wherein the second and third adhesive bands are configured to secure a first floor material set and a second floor material set to the top surface of the elongated rectangular moulding element either directly or indirectly respectively; and, a T-separator configured to adjoin the first floor material set and the second floor material set, wherein the T-separator is secured via a mechanical element adhered to the assembly via the first adhesive band.

2. The transition moulding assembly of claim 1, wherein the elongated rectangular moulding element includes a plurality of oblong holes for embedding adhesive or mortar and a plurality of round holes for placing mechanical fasteners to secure the elongated rectangular moulding element to the sub-floor.

3. The transition moulding assembly of claim 1, wherein the first, second, and third adhesive band extend the entire length of the elongated rectangular moulding element on the top surface.

4. The transition moulding assembly of claim 1, wherein the mechanical element is a clip.

5. The transition moulding assembly of claim 1, wherein the first adhesive band is constructed from compressible material.

6. The transition moulding assembly of claim 1, wherein the first floor material set and the second floor material set includes padding material or cement.

7. The transition moulding assembly of claim 1, wherein the elongated rectangular moulding element includes a crease running the entire length of the element to facilitate the folding or breaking of the element for when it is used against a wall or at the end of a floor such as on door sills or staircase.

* * * * *